US006540319B1

(12) United States Patent
Silverbrook

(10) Patent No.: US 6,540,319 B1
(45) Date of Patent: Apr. 1, 2003

(54) MOVEMENT SENSOR IN A MICRO ELECTRO-MECHANICAL DEVICE

(75) Inventor: Kia Silverbrook, Balmain (AU)

(73) Assignee: Silverbrook Research Pty LTD, Balmain (AU)

( * ) Notice: Subject to any disclaimer, the term of this patent is extended or adjusted under 35 U.S.C. 154(b) by 0 days.

(21) Appl. No.: 09/575,190

(22) Filed: May 23, 2000

(30) Foreign Application Priority Data

Jun. 30, 1999 (AU) ..... PQ 1309

(51) Int. Cl.[7] ..... B41J 29/393; B41J 2/05
(52) U.S. Cl. ..... 347/19; 347/65
(58) Field of Search ..... 347/19, 54, 65; 73/1.01, 1.79, 1.81; 324/130, 762; 250/310

(56) References Cited

U.S. PATENT DOCUMENTS 5,796,152 A * 8/1998 Carr et al. ..... 257/415
5,992,984 A * 11/1999 Imanaka et al. ..... 347/65
6,044,646 A * 4/2000 Silverbrook ..... 60/528
6,087,638 A * 7/2000 Silverbrook ..... 219/540

FOREIGN PATENT DOCUMENTS

EP 691542 A 1/1996
JP 08244221 * 9/1996 ..... B41J/2/045

OTHER PUBLICATIONS

Derwent Abstract Accession No. 96–481086/48, JP 8–244221 A (Minolta Camera KK) Sep. 24, 1996.

* cited by examiner

*Primary Examiner*—John Barlow
*Assistant Examiner*—Julian D. Huffman

(57) ABSTRACT

A micro electro-mechanical device embodied within an ink ejection nozzle having an actuating arm that is caused to move an ink displacing paddle when heat inducing electric current is passed through the actuating arm. The device incorporates a movement sensor that comprises a moving contact element that is formed integrally with the actuating arm, a fixed contact element that is formed integrally with a support structure of the device and electrical elements formed within the support structure for detecting contact that is made between the fixed contact element and the moving contact element. The movement sensor is provided for the purpose of facilitating testing of the device under various operating conditions.

7 Claims, 11 Drawing Sheets

MOVEMENT SENSOR IN A MICRO ELECTRO-MECHANICAL DEVICE

CO-PENDING APPLICATIONS

Various methods, systems and apparatus relating to the present invention are disclosed in the following co-pending applications filed by the applicant or assignee of the present invention simultaneously with the present application:

| | | | | |
|---|---|---|---|---|
| 09/575,197 | 09/575,195 | 09/575,159 | 09/575,132 | 09/575,123 |
| 09/575,148 | 09/575,130 | 09/575,165 | 09/575,153 | 09/575,118 |
| 09/575,131 | 09/575,116 | 09/575,144 | 09/575,139 | 09/575,186 |
| 09/575,185 | 09/575,191 | 09/575,145 | 09/575,192 | 09/575,181 |
| 09/575,193 | 9/575,156 | 09/575,183 | 09/575,160 | 09/575,150 |
| 09/575,169 | 09/575,184 | 09/575,128 | 09/575,180 | 09/575,149 |
| 09/575,179 | 09/575,133 | 09/575,143 | 09/575,187 | 09/575,155 |
| 09/575,196 | 09/575,198 | 09/575,178 | 09/575,164 | 09/575,146 |
| 09/575,174 | 09/575,163 | 09/575,168 | 09/575,154 | 09/575,129 |
| 09/575,124 | 09/575,188 | 09/575,189 | 09/575,162 | 09/575,172 |
| 09/575,170 | 09/575,171 | 09/575,161 | 09/575,141 | 09/575,125 |
| 09/575,142 | 09/575,140 | 09/575,190 | 09/575,138 | 09/575,126 |
| 09/575,127 | 09/575,158 | 09/575,117 | 09/575,147 | 09/575,152 |
| 09/575,176 | 09/575,151 | 09/575,177 | 09/575,175 | 09/575,115 |
| 09/575,114 | 09/575,113 | 09/575,112 | 09/575,111 | 09/575,108 |
| 09/575,109 | 09/575,182 | 09/575,173 | 09/575,194 | 09/575,136 |
| 09/575,119 | 09/575,135 | 09/575,157 | 09/575,166 | 09/575,134 |
| 09/575,121 | 09/575,137 | 09/575,167 | 09/575,120 | 09/575,122 |

The disclosure of these co-pending applications are incorporated herein by cross-reference.

Each application is temporarily identified by its docket number. This will be replaced by the corresponding USSN when available.

FIELD OF THE INVENTION

This invention relates to an integrated movement sensor within a micro electro-mechanical (MEM) device. The invention has application in ink ejection nozzles of the type that are fabricated by integrating the technologies applicable to micro electro-mechanical systems (MEMS) and complementary metal-oxide semiconductor ("CMOS") integrated circuits, and the invention is hereinafter described in the context of that application. However, it will be understood that the invention does have broader application, to a movement sensor within various types of MEM devices.

BACKGROUND OF THE INVENTION

A high speed pagewidth inkjet printer has recently been developed by the present Applicant. This typically employs in the order of 51200 inkjet nozzles to print on A4 size paper to provide photographic quality image printing at 1600 dpi. In order to achieve this nozzle density, the nozzles are fabricated by integrating MEMS-CMOS technology and in this context reference may be made to International Patent Application No. PCT/AU00/00338 by the present Applicant entitled "Thermal Actuator", which corresponds to U.S. patent application Ser. No. to be advised.

A difficulty that flows from the fabrication of such a printer is that there is no convenient way of ensuring that all nozzles that extend across the printhead or, indeed, that are located on a given chip will perform identically, and this problem is exacerbated when chips that are obtained from different wafers may need to be assembled into a given printhead. Also, having fabricated a complete printhead from a plurality of chips, it is difficult to determine the energy level required for actuating individual nozzles and for evaluating the continuing performance of a given nozzle.

SUMMARY OF THE INVENTION

The present invention may be defined broadly as providing a micro electro-mechanical device comprising:

a support structure, an actuating arm having a first end coupled to the support structure and a second end that is movable with respect to the support structure, the actuating arm being formed in part from an electrically resistive material and being arranged to conduct heat inducing electrical current from a current source within the support structure to effect movement of the actuating arm, and a movement sensor incorporated in the device.

The movement sensor comprises a moving contact element formed integrally with the actuating arm adjacent the second end of the actuating arm, a fixed contact element formed integrally with the support structure and positioned to be contacted by the moving contact element when the actuating arm moves to a predetermined extent under the influence of the heat inducing electrical current, and electrical circuit elements formed within the support structure for detecting contact between the fixed contact element and the moving contact element The above defined arrangement permits evaluation of the operation of the actuating arm and, hence, evaluation of the operation, function and performance of the complete MEM device.

PREFERRED FEATURES OF THE INVENTION

The MEM device preferably is in the form of a liquid ejector and most preferably is in the form of an ink ejection nozzle that is operable to eject an ink droplet upon actuation of the actuating arm. In this latter preferred form of the invention, the second end of the actuating arm preferably is coupled to an integrally formed paddle which is employed to displace ink from a chamber into which the actuating arm extends.

The actuating arm most preferably is formed from two similarly shaped arm portions which are interconnected in interlapping relationship. In this embodiment of the invention, a first of the arm portions is connected to a current supply and is arranged in use to be heated by current flow. However, the second arm portion functions to restrain linear expansion of the actuating arm as a complete unit and heat induced elongation of the first arm portion causes bending to occur along the length of the actuating arm. Thus, the actuating arm is effectively caused to pivot with respect to the substrate with heating and cooling of the first portion of the actuating arm.

The invention will be more fully understood from the following description of a preferred embodiment of an inkjet nozzle as illustrated in the accompanying drawings.

DETAILED DESCRIPTION OF THE INVENTION

Figure 1:
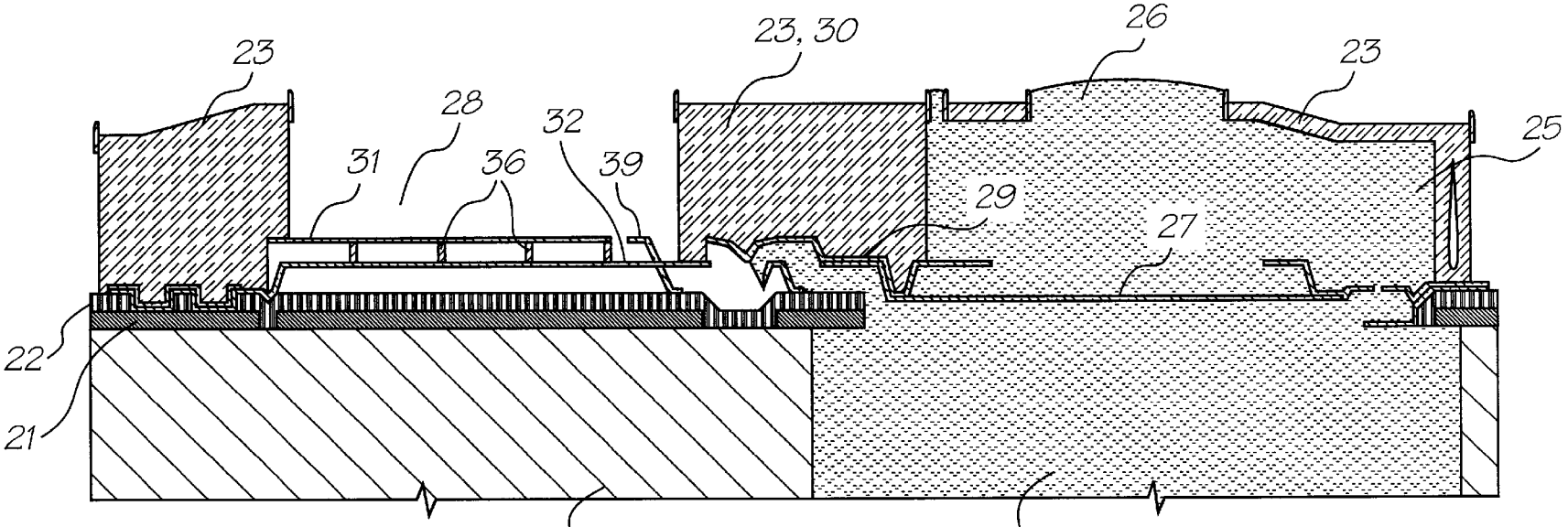
FIG. 1 shows a highly magnified cross-sectional elevation view of a portion of the inkjet nozzle.
Figure 2:
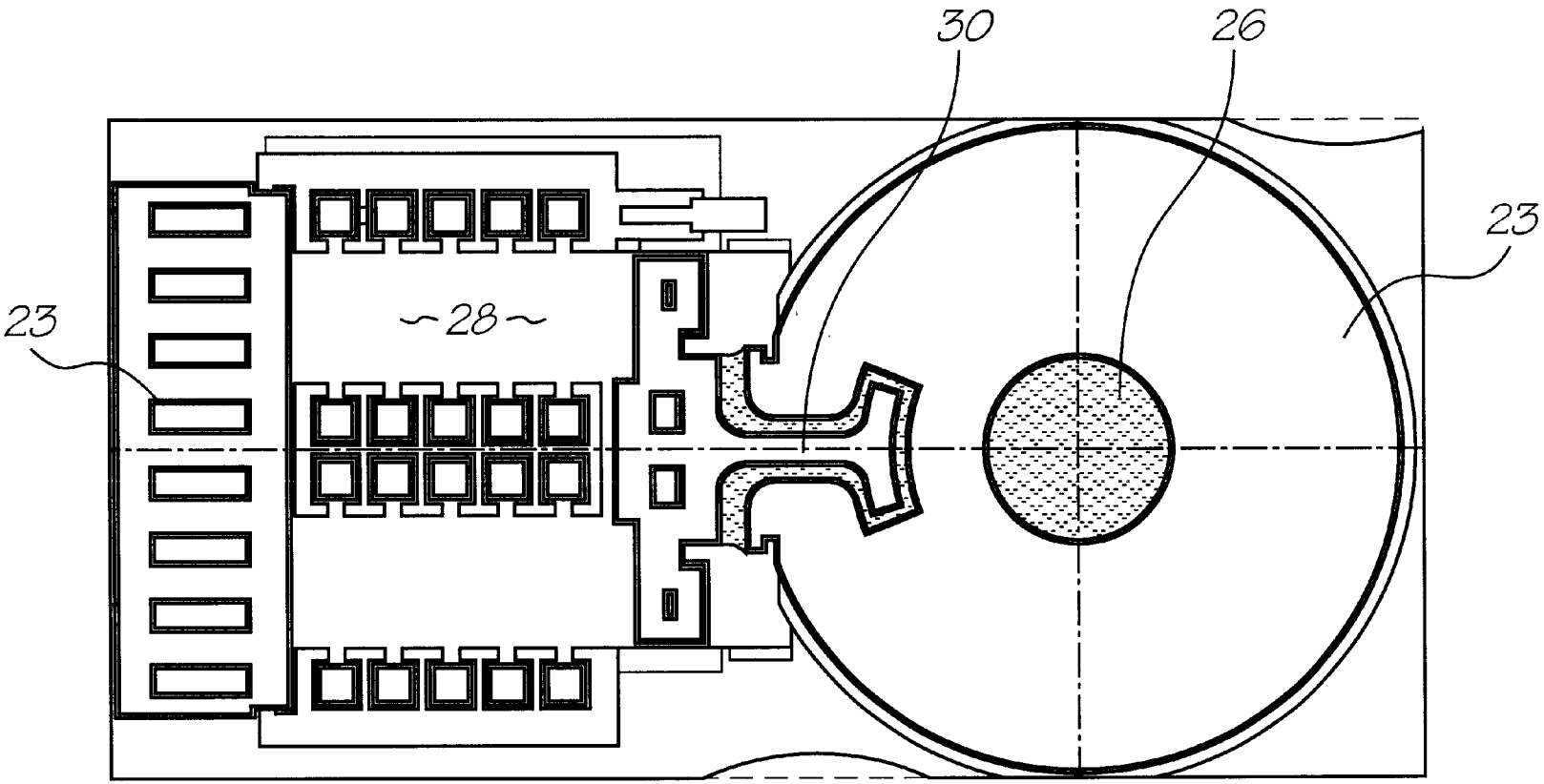
FIG. 2 shows a plan view of the inkjet nozzle of FIG. 1.

As illustrated with approximately 3000×magnification in FIG. 1 and other relevant drawing figures, a single inkjet nozzle device is shown as a portion of a chip that is fabricated by integrating MEMS and CMOS technologies. The complete nozzle device includes a support structure having a silicon substrate 20, a metal oxide semiconductor layer 21, a passivation layer 22, and a non-corrosive dielectric coating/chamber-defining layer 23. Reference may be made to the above identified International Patent Application No. PCT/AU00/00338 by the present Applicant entitled "Thermal Actuator", which corresponds to U.S. patent application Ser. No. to be advised, for a detailed disclosure of the fabrication of the nozzle device.

Figure 7:
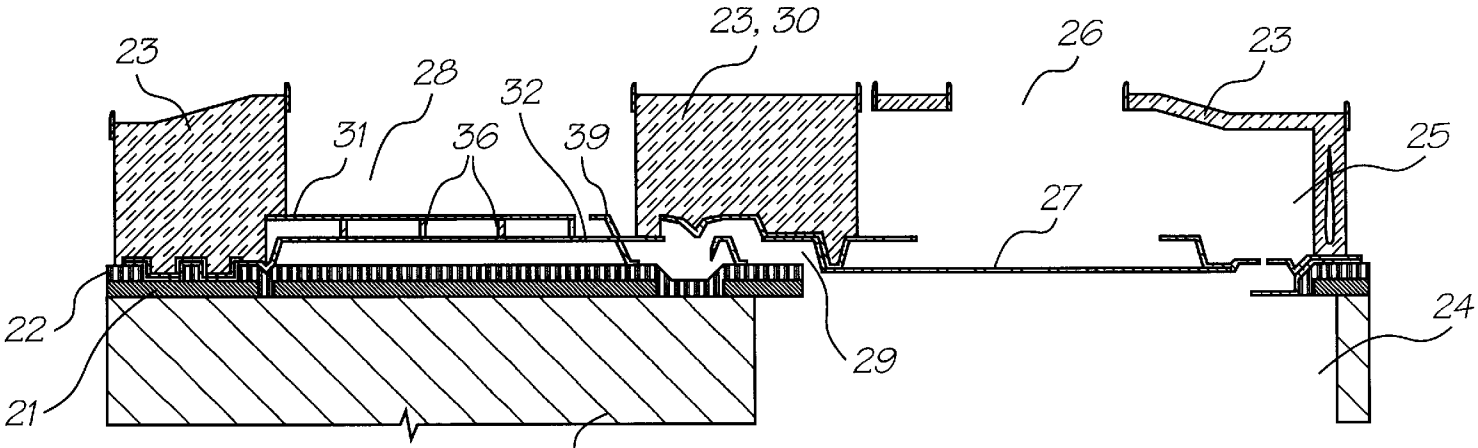
FIG. 7 shows a sectional elevation view of the nozzle of FIG. 1 but prior to charging with ink.

The nozzle device incorporates an ink chamber 24 which is connected to a source (not shown) of ink and, located above the chamber, a nozzle chamber 25. A nozzle opening 26 is provided in the chamber-defining layer 23 to permit displacement of ink droplets toward paper or other medium (not shown) onto which ink is to be deposited. A paddle 27 is located between the two chambers 24 and 25 and, when in its quiescent position, as indicated in FIGS. 1 and 7, the paddle 27 effectively divides the two chambers 24 and 25.

The paddle 27 is coupled to an actuating arm 28 by a paddle extension 29 and a bridging portion 30 of the dielectric coating 23.

Figure 3:
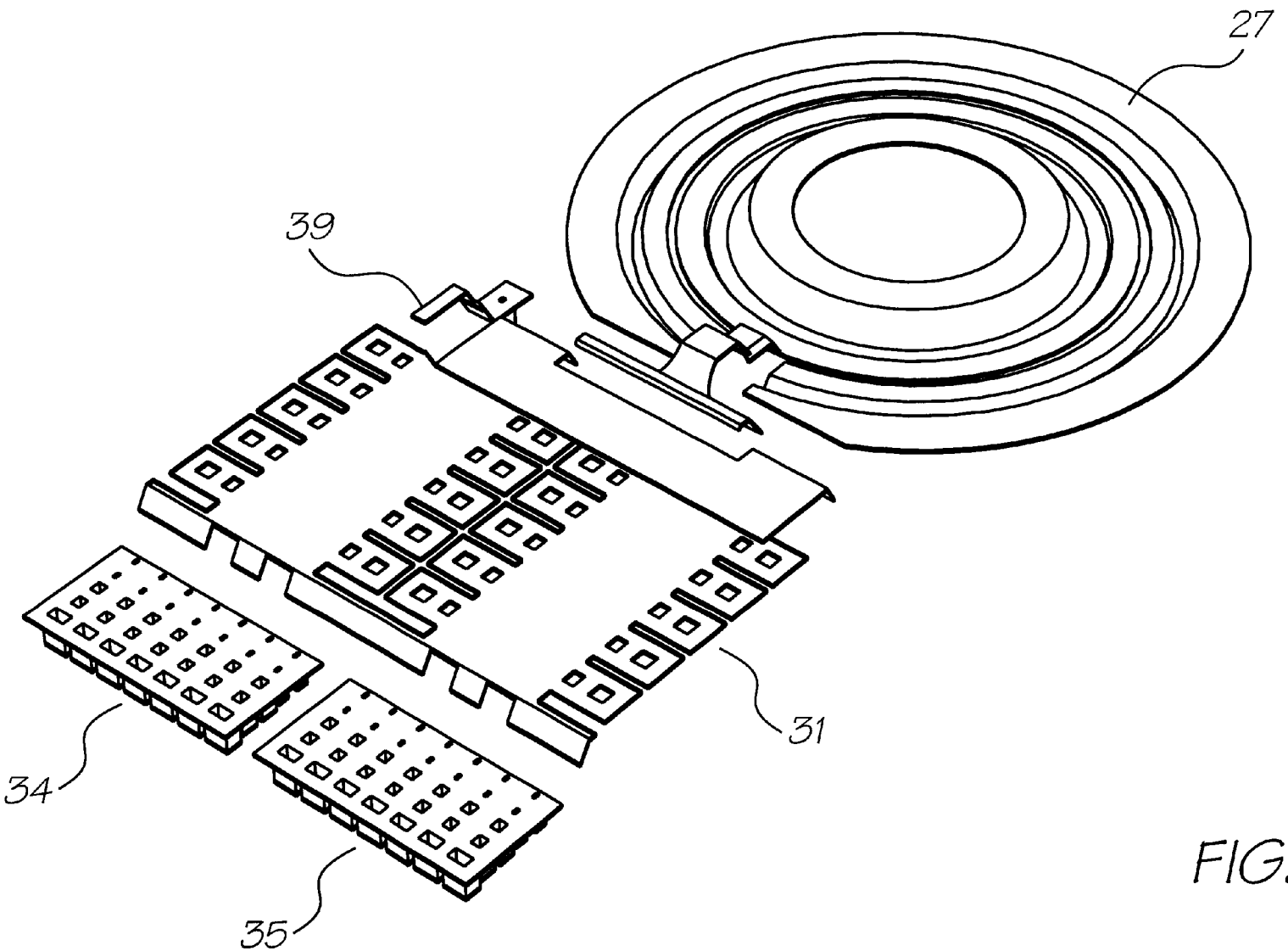
FIG. 3 shows a perspective view of an outer portion of an actuating arm and an ink ejecting paddle or of the inkjet nozzle, the actuating arm and paddle being illustrated independently of other elements of the nozzle.
Figure 4:
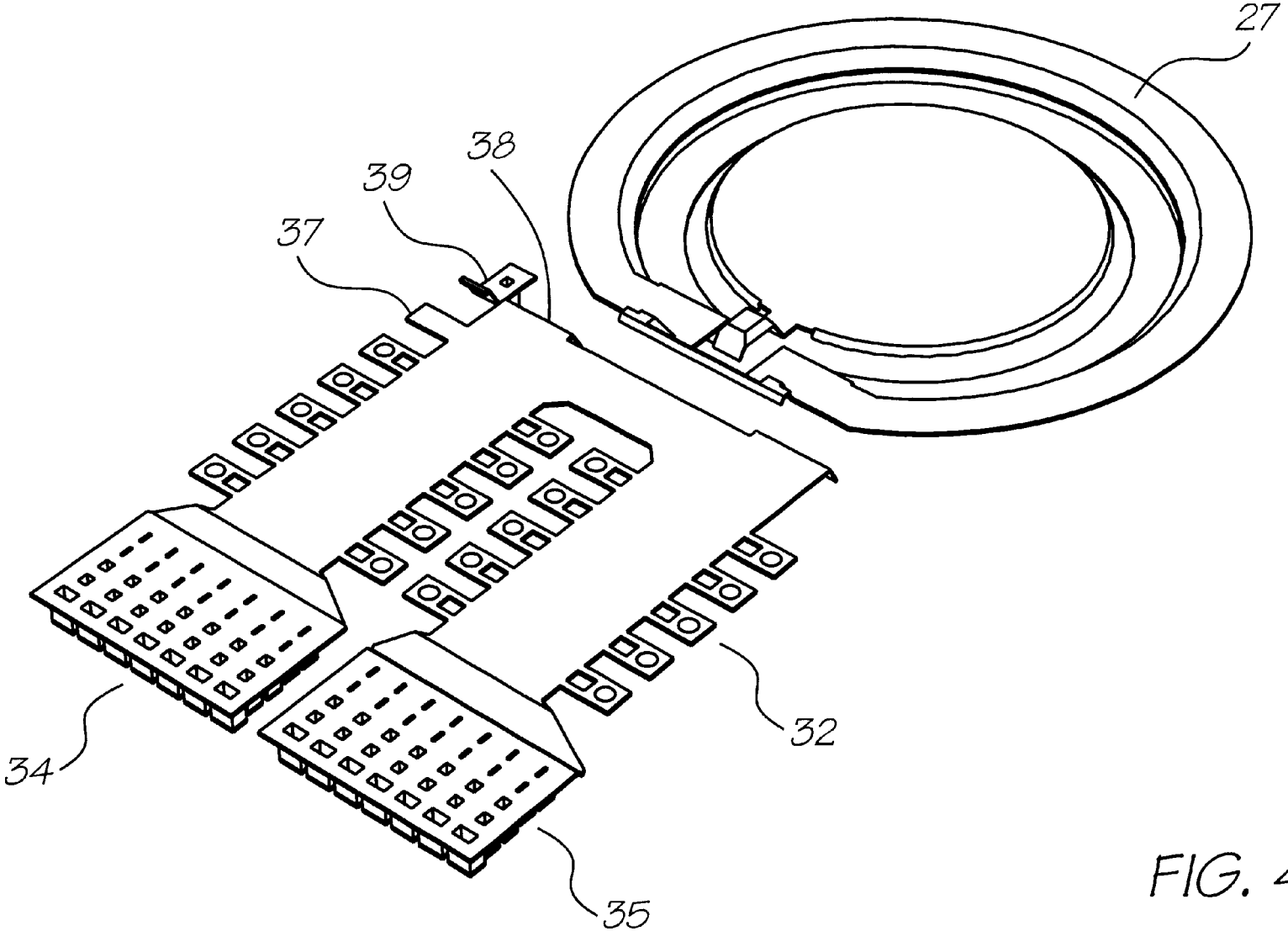
FIG. 4 shows an arrangement similar to that of FIG. 3 but in respect of an inner portion of the actuating arm.
Figure 5:
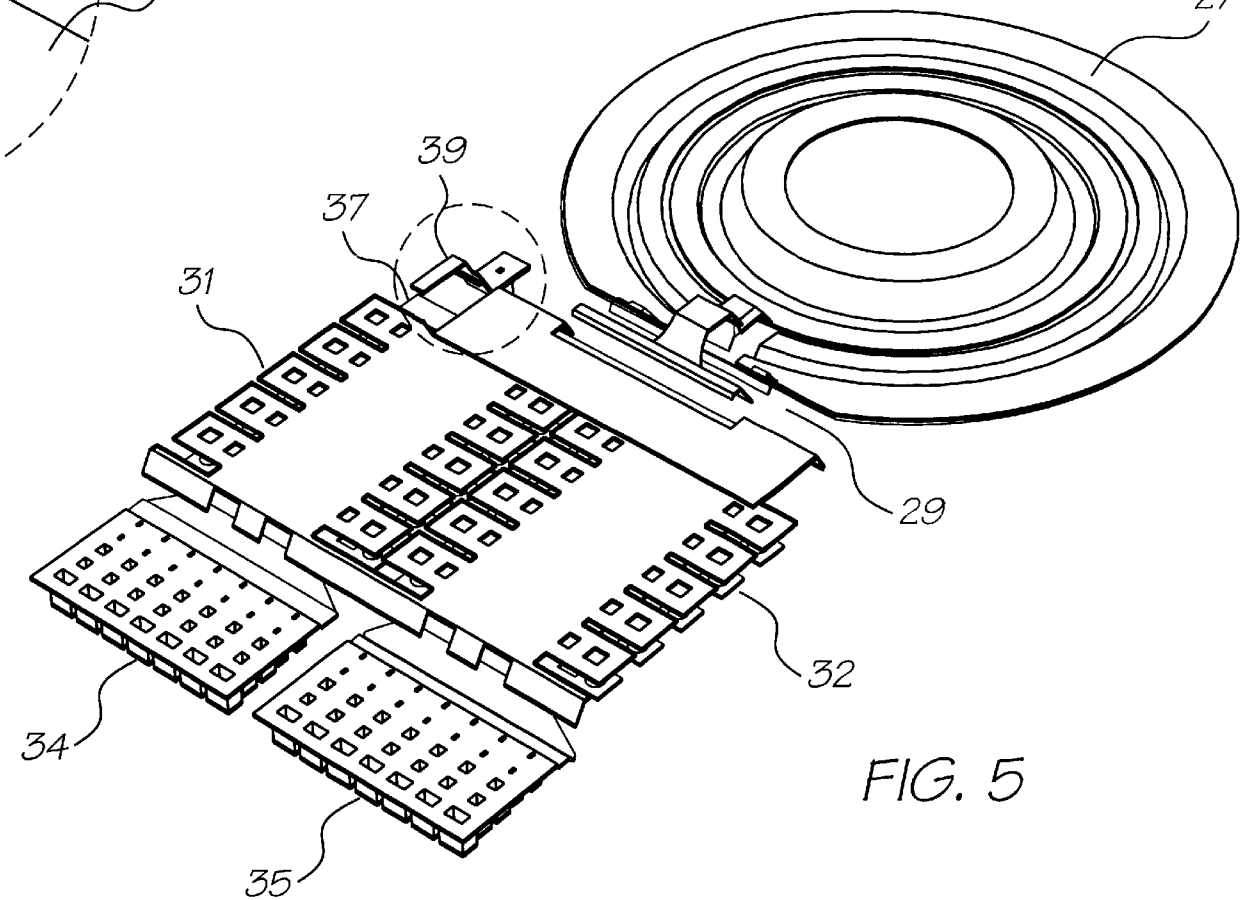
FIG. 5 shows an arrangement similar to that of FIGS. 3 and 4 but in respect of the complete actuating arm incorporating the outer and inner portions shown in FIGS. 3 and 4.
Figure 6:
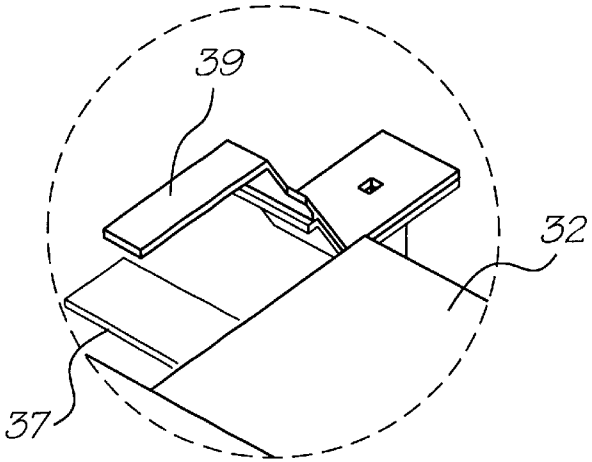
FIG. 6 shows a detailed portion of a movement sensor arrangement that is shown encircled in FIG. 5.

The actuating arm 28 is formed (i.e. deposited during fabrication of the device) to be pivotable with respect to the support structure or substrate 20. That is, the actuating arm has a first end that is coupled to the support structure and a second end 38 that is movable outwardly with respect to the support structure. The actuating arm 28 comprises outer and inner arm portions 31 and 32. The outer arm portion 31 is illustrated in detail and in isolation from other components of the nozzle device in the perspective view shown in FIG. 3. The inner arm portion 32 is illustrated in a similar way in FIG. 4. The complete actuating arm 28 is illustrated in perspective in FIG. 5, as well as in FIGS. 1, 7, 8, 9 and 10.

Figure 11:
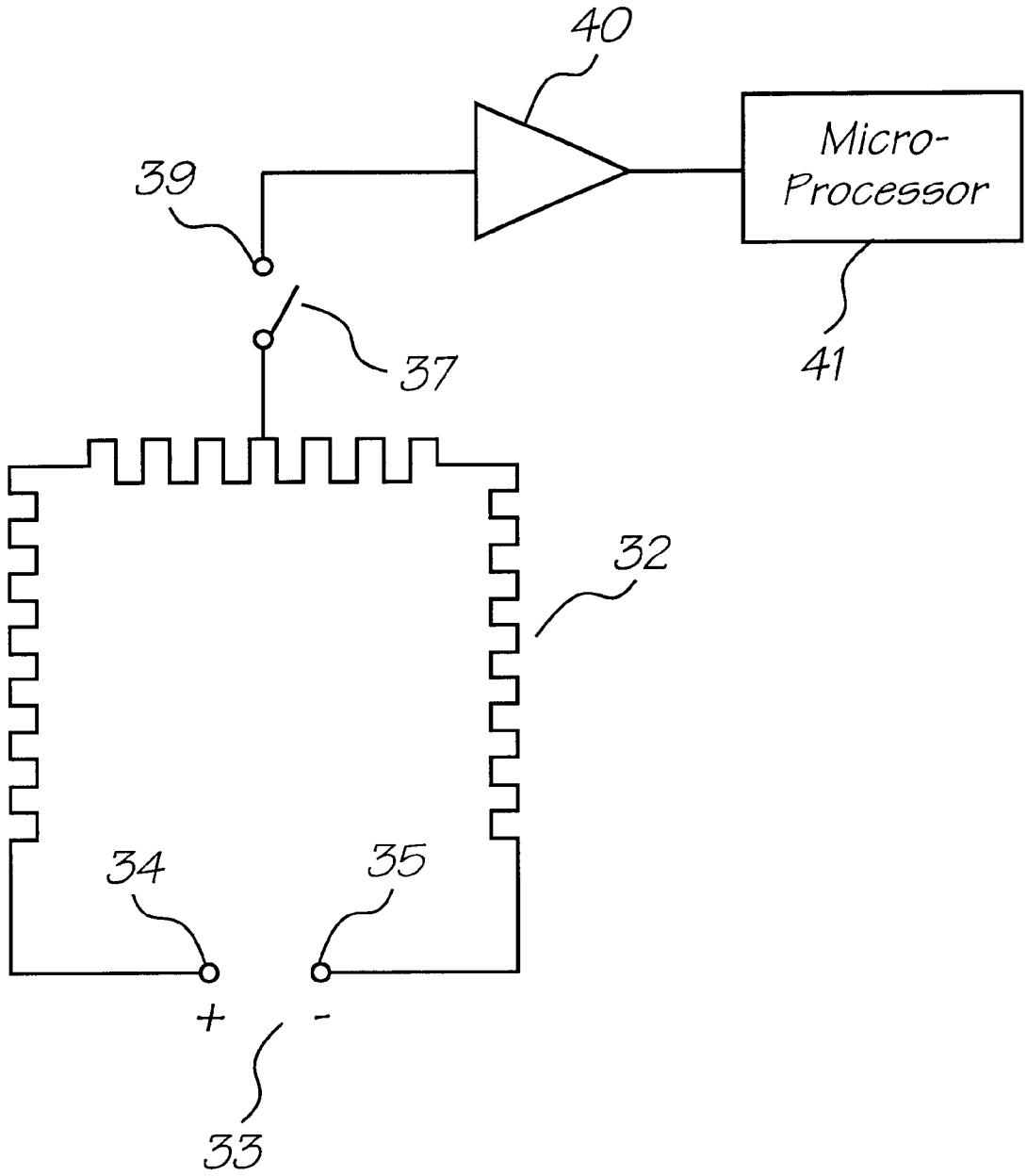
FIG. 11 shows a schematic representation of a portion of an electrical circuit that is embodied within the nozzle.

The inner portion 32 of the actuating arm 28 is formed from an titanium-aluminum-nitride ((Ti,Al)N reactively sputtered) deposit during formation of the nozzle device and it is connected electrically to a current source 33, as illustrated schematically in FIG. 11, within the CMOS structure. The electrical connection is made to end terminals 34 and 35, and application of an excitation (drive) voltage to the terminals results in current flow through the inner portion only of the actuating arm 28. The current flow causes resistance heating within the inner portion 32 of the actuating arm and consequential elongation of that portion of the arm.

The outer arm portion 31 of the actuating arm 28 is mechanically coupled to but electrically isolated from the inner arm portion 32 by posts 36. No current-induced heating occurs within the outer arm portion 31 and, as a consequence, voltage induced current flow through the inner arm portion 32 causes bending of the complete actuating arm 28 in the manner indicated in FIGS. 8, 9 and 10 of the drawings. This bending of the actuating arm 28 is equivalent to pivotal movement of the arm with respect to the substrate 20 and it results in displacement of the paddle 27 within the chambers 24 and 25.

An integrated movement sensor is provided within the device in order to determine the degree or rate of pivotal movement of the actuating arm 28 and, hence, of the paddle 27.

The movement sensor comprises a moving contact element 37 that is formed integrally with the inner portion 32 of the actuating arm 28 and which is electrically active when current is passing through the inner portion of the actuating arm. The moving contact element 37 is positioned adjacent the second end 38 of the actuating arm and, thus, with a voltage V applied to the end terminals 34 and 35, the moving contact element will be at a potential of approximately V/2. The movement sensor also comprises a fixed contact element 39 which is formed integrally with the CMOS layer 22 and which is positioned to be contacted by the moving contact element 37 when the actuating arm 28 pivots upwardly to a predetermined extent. The fixed contact element is connected electrically to amplifier elements 40 and to a microprocessor arrangement 41, both of which are shown in FIG. 11 and the component elements of which are embodied within the CMOS layer 22 of the device.

Figure 8:
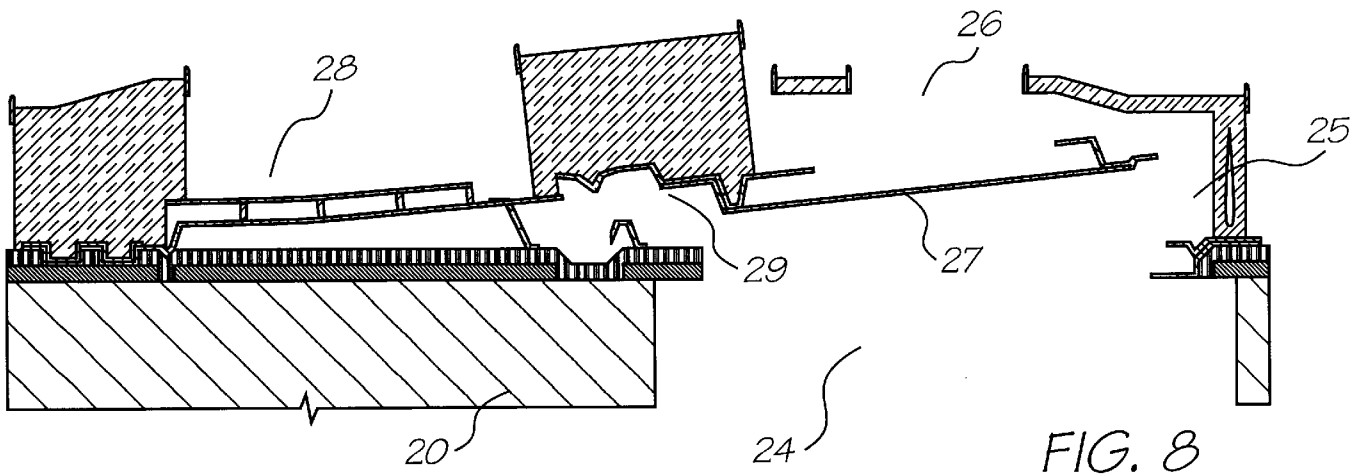
FIG. 8 shows a sectional elevation view of the nozzle of FIG. 7 but with the actuating arm and paddle actuated to a test position.
Figure 9:
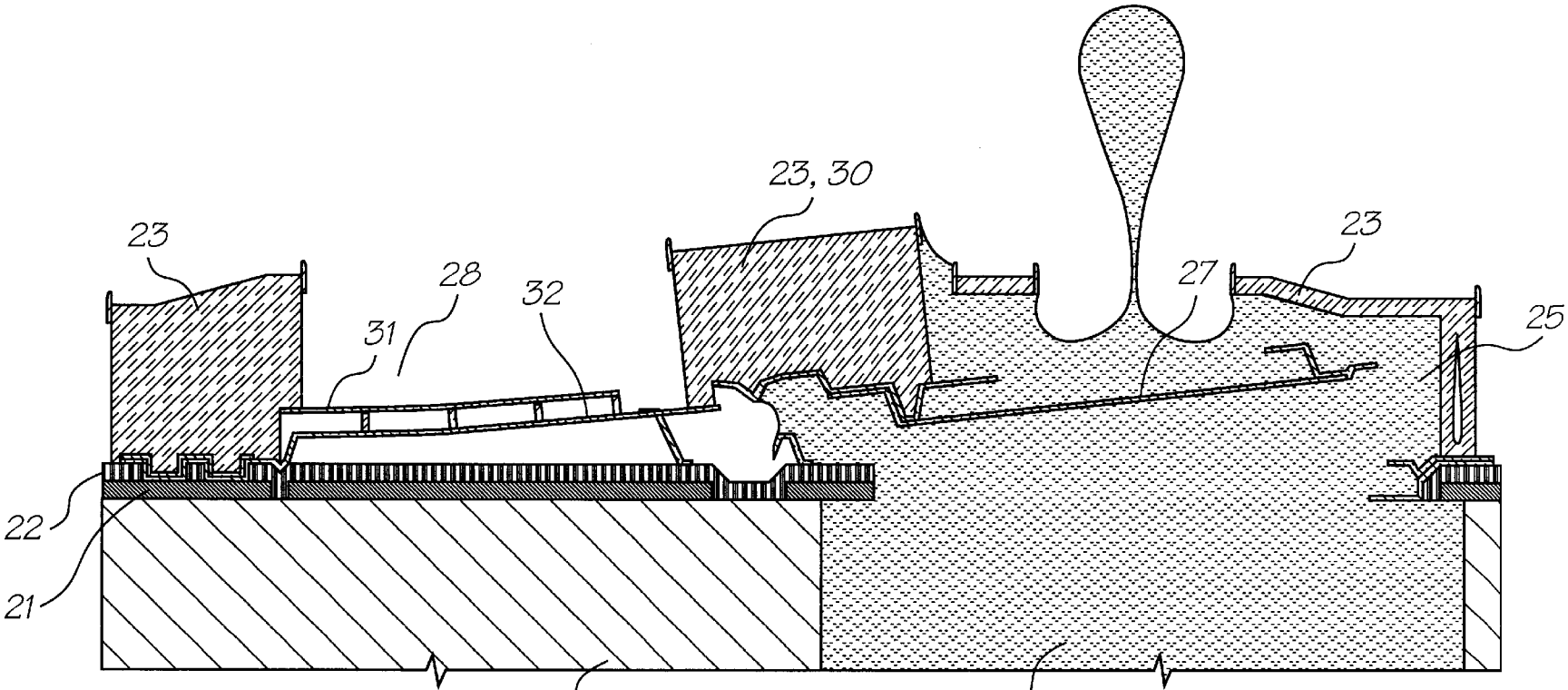
FIG. 9 shows ink ejection from the nozzle when actuated under test conditions.
Figure 10:
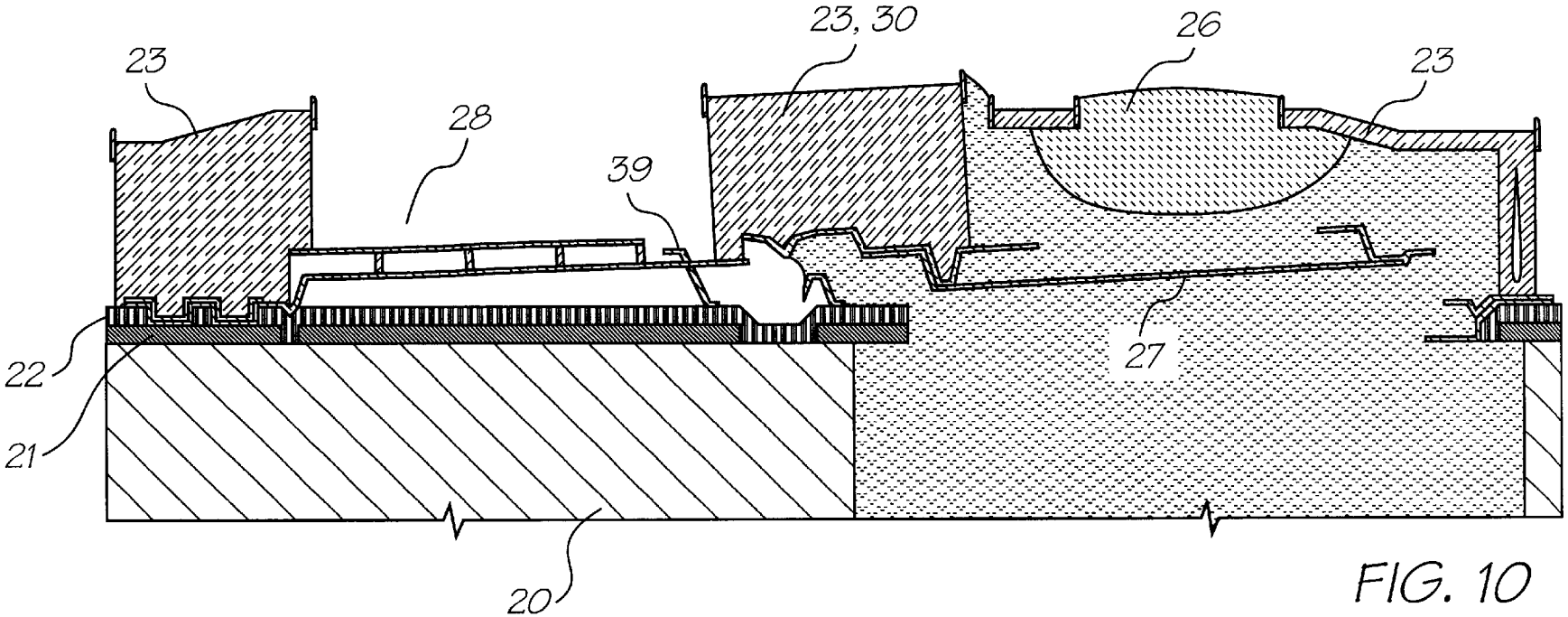
FIG. 10 shows a blocked condition of the nozzle when the actuating arm and paddle are actuated to an extent that normally would be sufficient to eject ink from the nozzle.

When the actuator arm 28 and, hence, the paddle 27 are in the quiescent position, as shown in FIGS. 1 and 7, no contact is made between the moving and fixed contact elements 37 and 39. At the other extreme, when excess movement of the actuator arm and the paddle occurs, as indicated in FIGS. 8 and 9, contact is made between the moving and fixed contact elements 37 and 39. When the actuator arm 28 and the paddle 27 are actuated to a normal extent sufficient to expel ink from the nozzle, no contact is made between the moving and fixed contact elements. That is, with normal ejection of the ink from the chamber 25, the actuator arm 28 and the paddle 27 are moved to a position partway between the positions that are illustrated in FIGS. 7 and 8. This (intermediate) position is indicated in FIG. 10, although as a consequence of a blocked nozzle rather than during normal ejection of ink from the nozzle.

Figure 12:
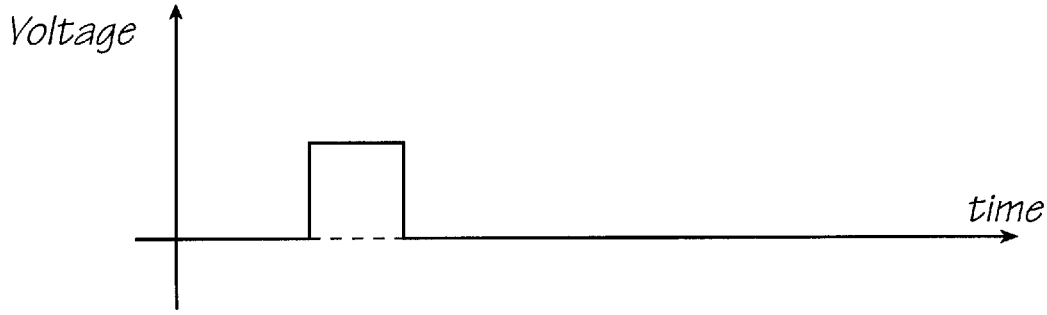
FIG. 12 shows an excitation-time diagram applicable to normal (ink ejecting) actuation of the nozzle actuating arm.
Figure 14:
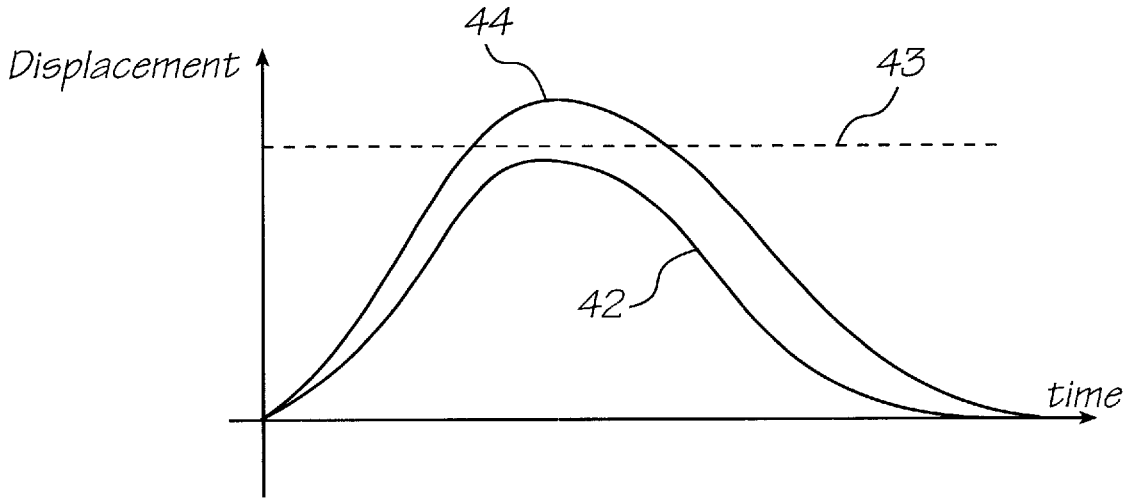
FIG. 14 shows comparative displacement-time curves applicable to the excitation-time diagrams shown in FIGS. 12 and 13.

FIG. 12 shows an excitation-time diagram that is applicable to effecting actuation of the actuator arm 28 and the paddle 27 from a quiescent to a lower-than-normal ink ejecting position. The displacement of the paddle 27 resulting from the excitation of FIG. 12 is indicated by the lower graph 42 in FIG. 14, and it can be seen that the maximum extent of displacement is less than the optimum level that is shown by the displacement line 43.

Figure 13:
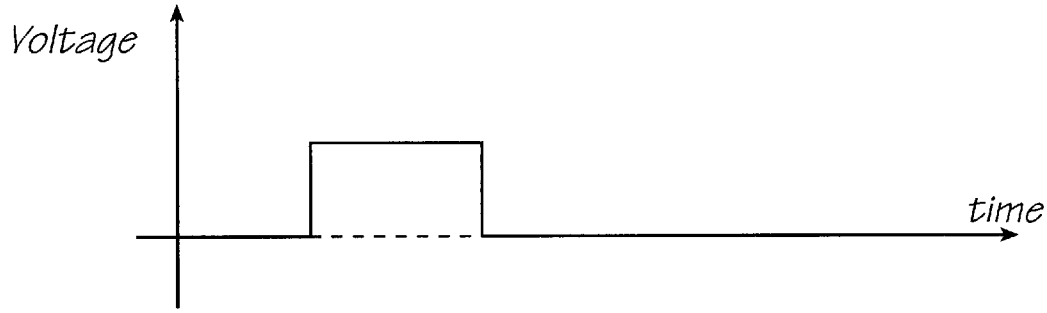
FIG. 13 shows an excitation-time diagram applicable to test actuation of the nozzle actuating arm.

FIG. 13 shows an expanded excitation-time diagram that is applicable to effecting actuation of the actuator arm 28 and the paddle 27 to an excessive extent, such as is indicated in FIGS. 8 and 9. The displacement of the paddle 27 resulting from the excitation of FIG. 13 is indicated by the upper graph 44 in FIG. 14, from which it can be seen that the maximum displacement level is greater than the optimum level indicated by the displacement line 43.

Figure 15:
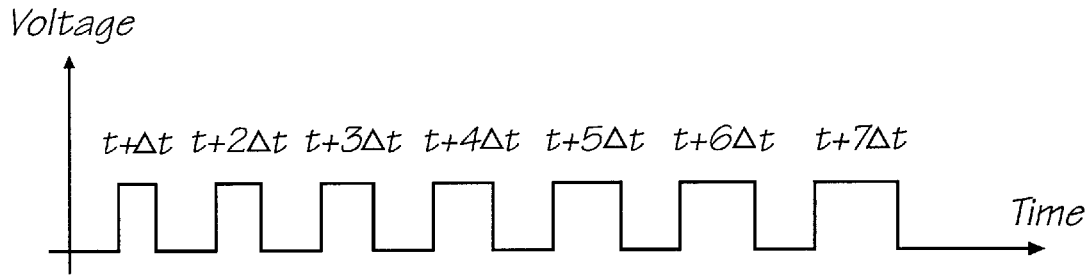
FIG. 15 shows an excitation-time diagram applicable to various testing and calibration procedures to which the nozzle might be subjected.
Figure 16:
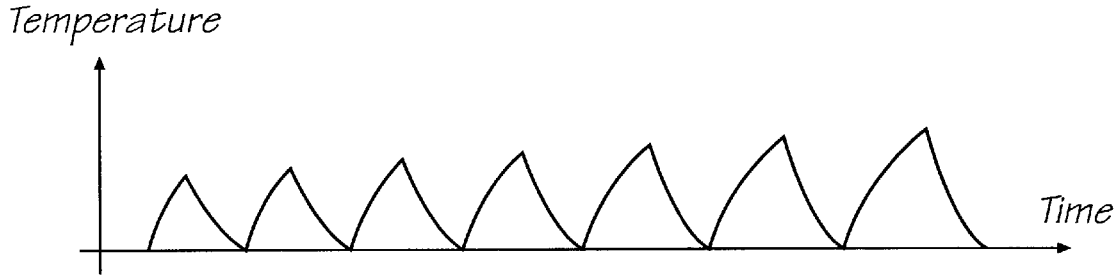
FIG. 16 shows a temperature-time diagram that is applicable to the nozzle actuating arm and which corresponds with the excitation-time diagram of FIG. 15.
Figure 17:
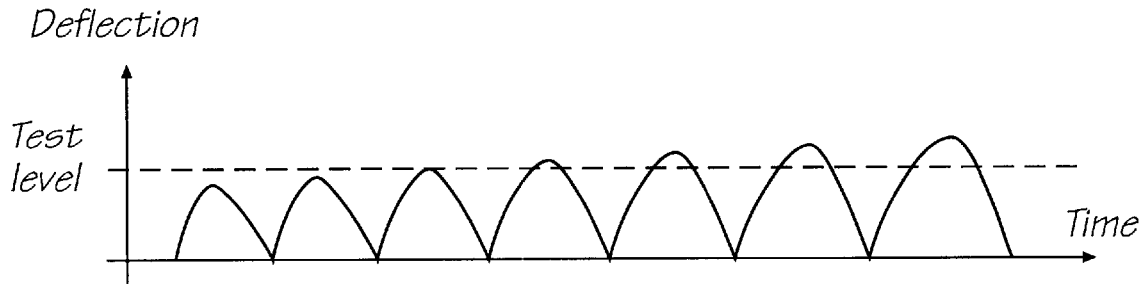
FIG. 17 shows a deflection-time diagram that is applicable to the nozzle actuator and which corresponds with the excitation/heating-time diagrams of FIGS. 15 and 16.

FIGS. 15, 16 and 17 shows plots of excitation voltage, actuator arm temperature and paddle deflection against time for increasing excitation applied to the actuating arm 28. These plots have relevance to various tests that may be applied to the nozzle device using the movement sensor arrangement incorporating the moving contact 37 and the fixed contact 39.

Variations and modifications may be made in respect of the device as described above as a preferred embodiment of the invention without departing from the scope of the appended claims.

I claim:

1. A micro electro-mechanical device incorporated in a liquid ejection device having a nozzle opening and a liquid receiving chamber, the micro electro-mechanical device comprising:

an actuating arm having a first end coupled to the support structure and a second end that is movable with respect to the support structure, the actuating arm being formed in part from an electrically resistive material and being arranged to conduct heat inducing electrical current from a current source within the support structure to effect movement of the actuating arm to effect ejection of liquid from the chamber via said nozzle opening, a moving contact element formed integrally with the actuating arm adjacent the second end of the actuating arm, a fixed contact element formed integrally with the support structure and positioned to be contacted by the moving contact element when the actuating arm moves to an extent greater than that necessary to eject liquid from the chamber via said nozzle under the influence of the heat inducing electrical current, and electrical circuit elements formed within the support structure for detecting contact between the fixed contact element and the moving contact element.

2. The device as claimed in claim 1 wherein the electrical circuit elements are embodied in CMOS structures within the support structure.

3. The device as claimed in claim 1 wherein the actuating arm is arranged such that the second end of the actuating arm moves outwardly with respect to the support structure with passage of heat inducing electric current through the actuating arm and moves inwardly upon termination of current flow through the actuating arm.

4. The device as claimed in claim 3 wherein the actuating arm comprises an inner arm portion that is formed from the electrically resistive material and an outer arm portion that is mechanically coupled to but electrically isolated from the inner arm portion.

5. The device as claimed in claim 1 wherein said liquid is ink.

6. The device as claimed in claim 5 wherein the actuating arm is coupled to a paddle that is positioned within the chamber and wherein the paddle is movable by the actuating arm to expel the ink through a nozzle opening that communicates with the chamber.

7. The device as claimed in claim 6 wherein the moving contact element is formed as a lateral projection of one side of the inner portion of the actuating arm.

* * * * *